US009482009B2

(12) United States Patent
Krogsgaard et al.

(10) Patent No.: US 9,482,009 B2
(45) Date of Patent: Nov. 1, 2016

(54) CONNECTOR ELEMENT FOR USE IN A FLASHING ASSEMBLY FOR ROOF WINDOWS MOUNTED SIDE-BY-SIDE AND A METHOD FOR MOUNTING A FLASHING ASSEMBLY

(71) Applicant: VKR HOLDING A/S, Hørsholm (DK)

(72) Inventors: Torben Krogsgaard, Horsens (DK); Michael Nygaard, Odense C (DK)

(73) Assignee: VKR HOLDING A/S, Horsholm (DK)

( * ) Notice: Subject to any disclaimer, the term of this patent is extended or adjusted under 35 U.S.C. 154(b) by 0 days.

(21) Appl. No.: 14/915,606

(22) PCT Filed: Aug. 29, 2014

(86) PCT No.: PCT/DK2014/050260

§ 371 (c)(1),
(2) Date: Feb. 29, 2016

(87) PCT Pub. No.: WO2015/028030

PCT Pub. Date: Mar. 5, 2015

(65) Prior Publication Data

US 2016/0222669 A1 Aug. 4, 2016

(30) Foreign Application Priority Data

Aug. 30, 2013 (DK) ..... 2013 70486

(51) Int. Cl.
*E04D 13/147* (2006.01)
*E04D 13/03* (2006.01)

(52) U.S. Cl.
CPC ..... *E04D 13/1475* (2013.01); *E04D 13/03* (2013.01)

(58) Field of Classification Search
CPC ..... E04D 13/1473; E04D 13/147; E04D 13/1475; E04D 13/03; E04D 13/1415; E04D 13/1407; E04D 13/15; E04D 13/0315; E04D 13/031; E04D 13/0305; E04D 13/032; E06B 1/62
USPC ..... 52/58–62, 200
See application file for complete search history.

(56) References Cited

U.S. PATENT DOCUMENTS 5,271,192 A * 12/1993 Nothum, Sr. ..... E04D 13/076 248/48.2
5,355,644 A * 10/1994 Guhl ..... E04D 13/1415 52/200

(Continued)

FOREIGN PATENT DOCUMENTS

DK EP 2472027 A2 * 7/2012 ..... E04D 13/0315
DK EP 2472029 A1 * 7/2012 ..... E04D 13/031

(Continued)

*Primary Examiner* — Brian Glessner
*Assistant Examiner* — Adam Barlow
(74) *Attorney, Agent, or Firm* — Timothy D. St. Clair; Nexsen Pruet, LLC

(57) ABSTRACT

The invention relates to a connector element for use in a flashing assembly for roof windows mounted side-by-side comprising at least two flashing members. The exterior side of the connector element having an exterior side intended for facing the exterior in the mounted state comprises a gutter with two longitudinal edges each being adapted for engagement with an engagement section of a flashing member. At least two flanges projecting from the interior side, which is intended for facing the roof in the mounted state, and in parallel with the longitudinal edges of the gutter are adapted for coming into engagement with a mounting bracket arrangement including at least two mounting brackets associated with two different roof windows and adapted for a locking engagement with the mounting bracket arrangement thereby fixating the connector element in relation to the mounting bracket arrangement in at least one direction. Each of the at least two flanges are intended for coming into abutment with a surface of one of the two mounting brackets and each flange is provided with two or more curved recesses, each recess being adapted for riding on intermediate members of the mounting bracket arrangement. The invention also relates to method for mounting a flashing assembly.

19 Claims, 19 Drawing Sheets

(56) References Cited

Figure 1:
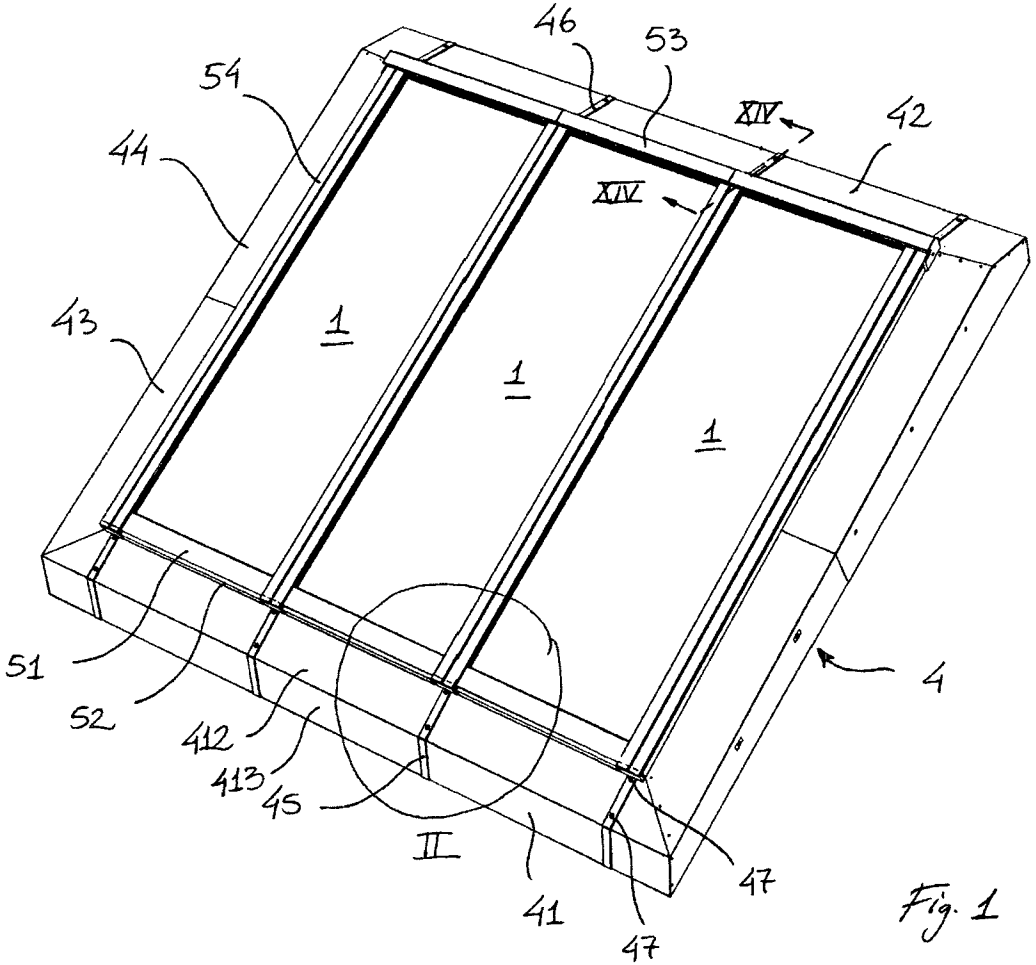

U.S. PATENT DOCUMENTS 6,254,039 B1 * 7/2001 Zimmerman ..... E04D 13/0725 248/48.1
9,347,691 B2 * 5/2016 West ..... H02S 30/10
2010/0018138 A1 * 1/2010 Lundsgaard ..... E04D 13/0354 52/200
2014/0109496 A1 * 4/2014 Stapleton ..... E04D 13/00 52/173.3

FOREIGN PATENT DOCUMENTS

EP 2472027 A2 7/2012
EP 2472029 A1 7/2012

* cited by examiner

CONNECTOR ELEMENT FOR USE IN A FLASHING ASSEMBLY FOR ROOF WINDOWS MOUNTED SIDE-BY-SIDE AND A METHOD FOR MOUNTING A FLASHING ASSEMBLY

The present invention relates to a connector element for use in a flashing assembly for roof windows mounted side-by-side comprising at least two flashing members each having a leg intended for being arranged so that it projects away from the window frame, said connector element having an exterior side intended for facing the exterior in the mounted state, an interior side intended for facing the roof in the mounted state, a first end intended for facing the window and a second open end intended for facing away from the window, where the exterior side comprises a gutter with two longitudinal edges extending between the first and second ends, each of said longitudinal edges being adapted for engagement with an engagement section of a flashing member, and where at least one flange projecting from the interior side is adapted for coming into engagement with a mounting bracket on a roof window. The invention further relates to windows mounted with such a connector element and to a method for mounting a flashing assembly on roof windows mounted side-by-side.

Such a connector element is known from the EP2472029 and has proven to work very well when mounting flashing assemblies on groups of windows with frames made from glass fibre reinforced polymers or materials, which are not well suited for receiving screws. Erroneous mounting have, however, been seen and the connector element may only be use with windows mounted with certain inclinations.

It is therefore the object of the invention to provide a connector element and a method for mounting a flashing assembly, which makes the mounting process easier and increases the versatility of the connector element.

This object is achieved with a connector element where at least two flanges projecting from the interior side in parallel with the longitudinal edges of the gutter are adapted for a locking engagement with a mounting bracket arrangement including at least two mounting brackets associated with two different roof windows mounted side-by-side, said locking engagement fixating the connector element in relation to the mounting bracket arrangement in at least one direction, each of the at least two flanges being intended for coming into abutment with a surface of one of the two mounting brackets, and each flange being provided with two or more curved recesses, each recess being adapted for riding on intermediate members of the mounting bracket arrangement.

The locking engagement, which preferably keeps the connector elements from moving in the longitudinal direction of the gutter, not only keeps the connector element in place during the subsequent mounting of the flashing assembly, but also provides tactile feedback to the person doing the installation work.

Bringing the connector element comes into engagement with the mounting bracket assembly will usually, depending on the design of the engaging parts and the strength of the engagement, involve overcoming a slight resistance, which, when felt, may be taken as an indication of correct mounting.

When the curved recesses in the flanges pass over the intermediate members this may be felt as a slight upwards and downwards movement, thus providing a good tactile feedback, and once in place the connector element will have to be pulled toward the exterior, away from the intermediate members, to be able to move in the longitudinal direction of the gutter.

Other properties of the flanges such as the distance between them may, however, also provide or contribute to a tactile feed-back.

To benefit the most from the tactile feedback the engagement is preferably of a snap-locking type, where the resistance is wholly or partially overcome when the engagement is established.

In one embodiment unintended movement towards the exterior is prevented by the connector element being provided with an extension of the gutter at the first end adapted for projecting between a flashing member and the frame of a window and arranging this extension underneath a projection on the frame or another member attached thereto.

To provide further stability the connector element may comprise a third flange projecting from the interior side, said third flange being perpendicular to the longitudinal edges of the gutter and being adapted for abutting lower outer ends of the two mounting brackets facing away from the window frame. This third flange will serve as a stop preventing the connector element from being pushed too far towards the window, which may particularly be a problem when operators or the like, which has to be covered by the flashing assembly, is provided on the outer side of the window frame.

The third flange will further prevent wind from blowing into spaces in the mounting bracket arrangement and thus both serve insulating purposes and prevent snow and dirt from penetrating too far into the construction.

The connector element will often be covered by means of a intermediate flashing member spanning from a flashing member on one side of the connector element to a flashing member on the other side of the connector element. For use in the attachment of such an intermediate flashing member, two or more raised sections may be provided in the gutter for receiving screws or like fasteners. The raised sections may be simple cylindrical bosses, but more complex designs are also possible, for example to provide a larger area of support for the intermediate flashing member.

To facilitate correct mounting of the flashing member the raised sections or possibly the entire connector element may advantageously made from a white or bright-coloured material. The bright colour will make it easy to see the raised sections through the screw holes in the intermediate flashing member and thus establish if the intermediate flashing member is in the correct position.

One or more of the raised sections may be provided with projections fitting into depressions in a flashing member or vice versa, thereby providing a mechanical engagement between the connector element and the intermediate flashing member. Such an engagement may not only contribute to the fastening of the flashing member but may also provide a tactile feedback of correct mounting as described with reference to the engagement between the connector element and the mounting bracket above. The provision of such projections is independent of the possible use of the raised projections as point of attachment for screws or like fasteners and thus also of the use of a bright-coloured material, but it will be understood that a combination of these features will be advantageous.

In normal use two points of attachment of an intermediate flashing member to the connector element is sufficient, but the connector element may nonetheless be provided with three or more raised sections. This will allow the same connector element to be used for several different installation situations by using one pair of raised section in one installation situation and another pair in another installation situation. It will also possible to shorten the connector element by cutting off the outermost end, possibly including one or more raised sections, thereby adapting it for a particular installation situation, and cutting indications or guides may be provided on the connector element to show where to cut. Likewise, the connector element may be provided with one or more projections or depressions adapted for engagement with an adaptor element, so that it may be made longer than normal.

To provide a reliable fastening of the connector element it is preferred to insert a fastener through parallel holes in the mounting brackets and the connector element. The fastener may be a common screw, pin or peg, but as such loose items are easily lost when working on a roof, it is suggested that the connector element comprises a fastener formed in one with the connector element and adapted for being broken off before use. This is particularly advantageous when the connector element and fastener are made from plastic by moulding, but it is also possible to provide an interconnection between a connector element and a fastener of different materials.

Figure 2:
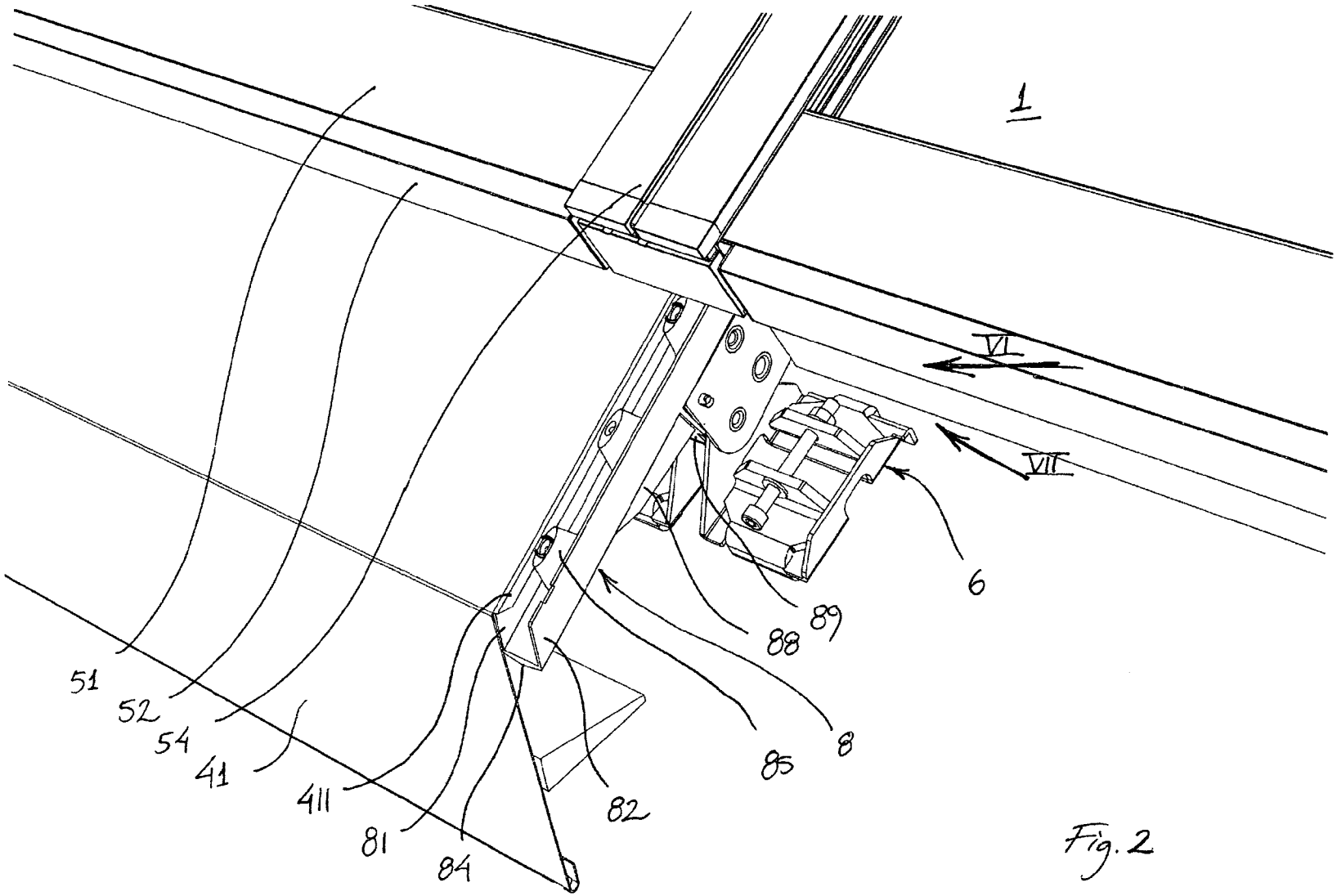
Figure 3:
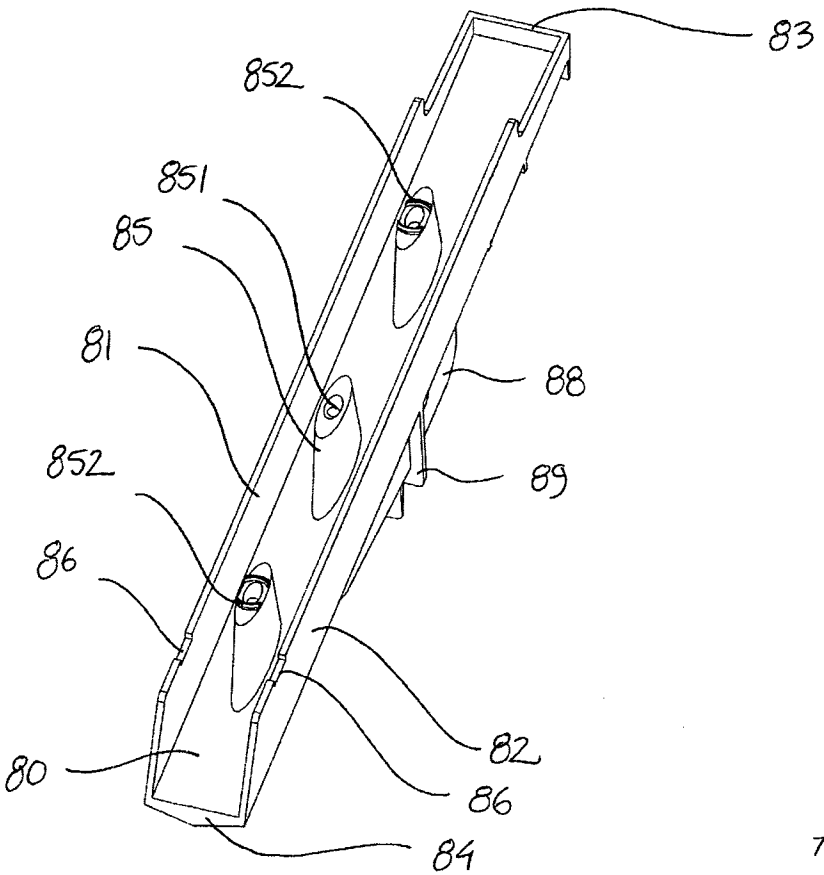
Figure 4:
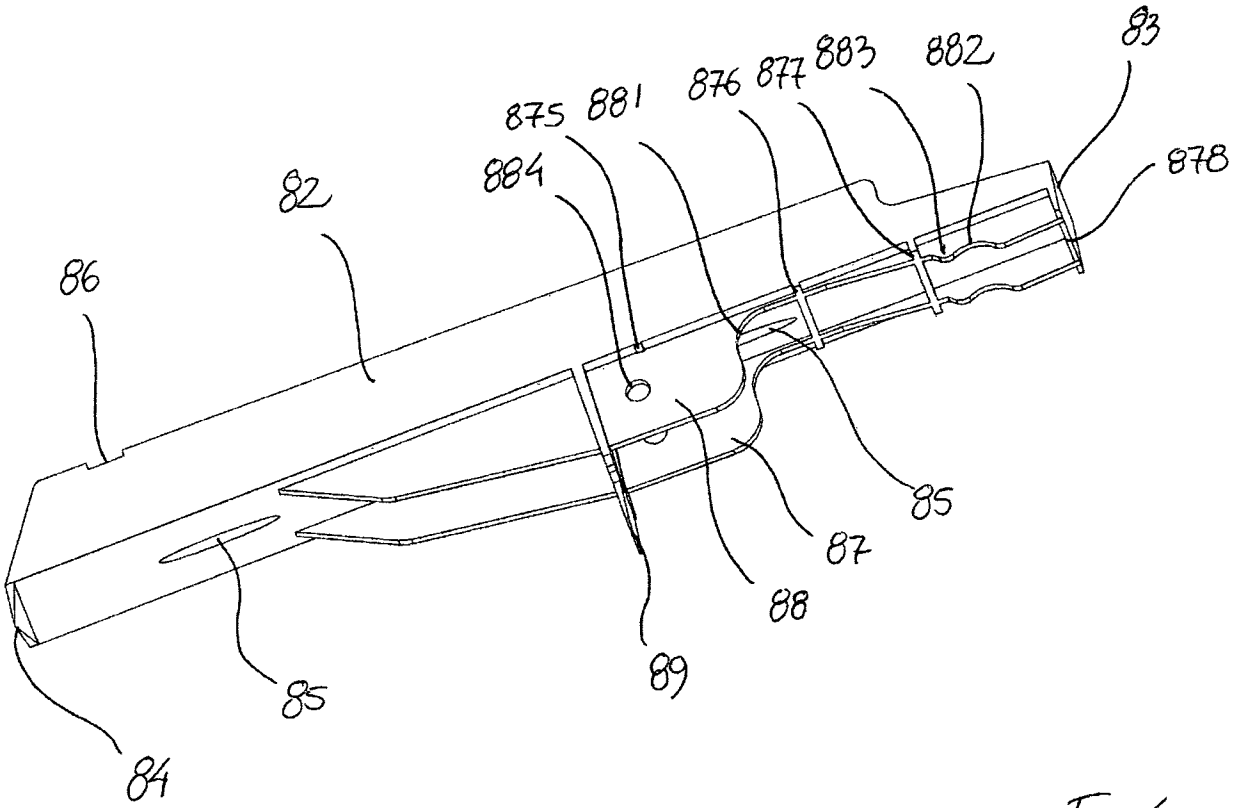
Figure 5:
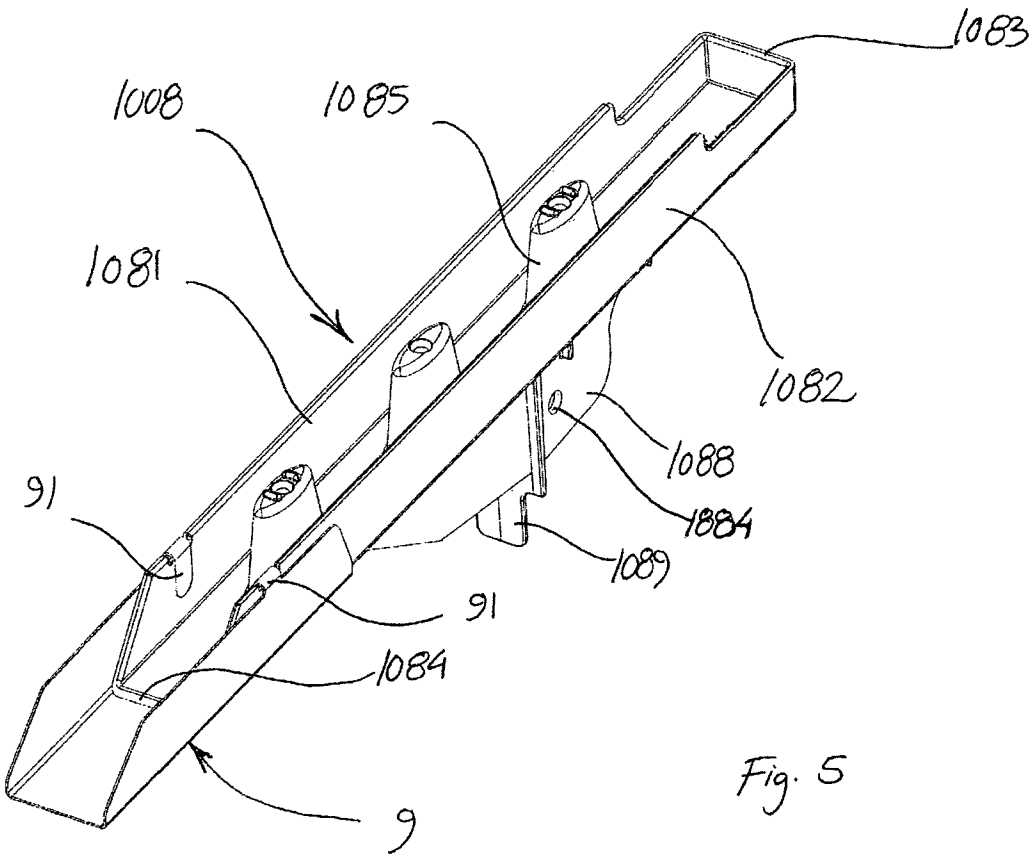
Figure 6:
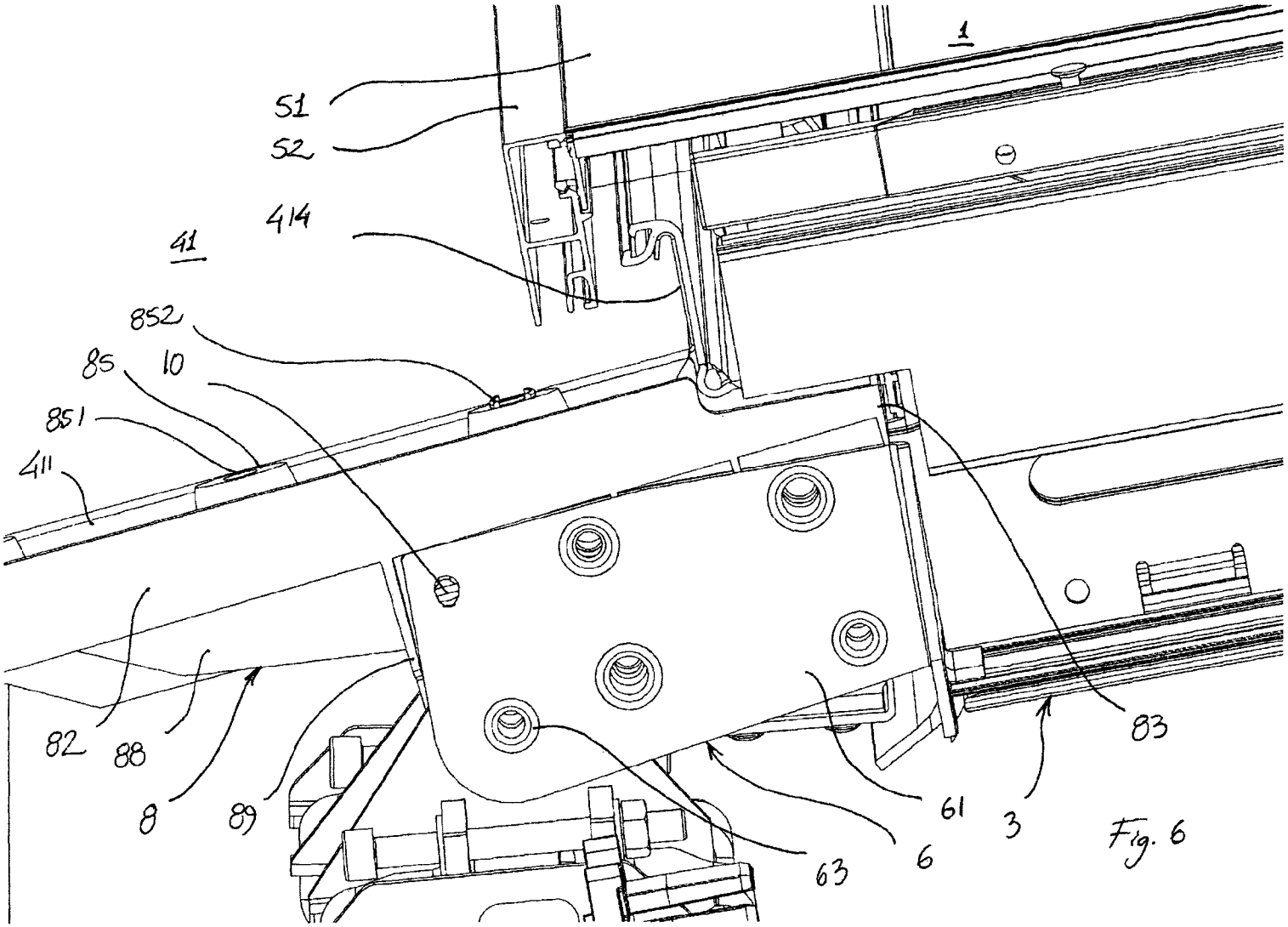
Figure 7:
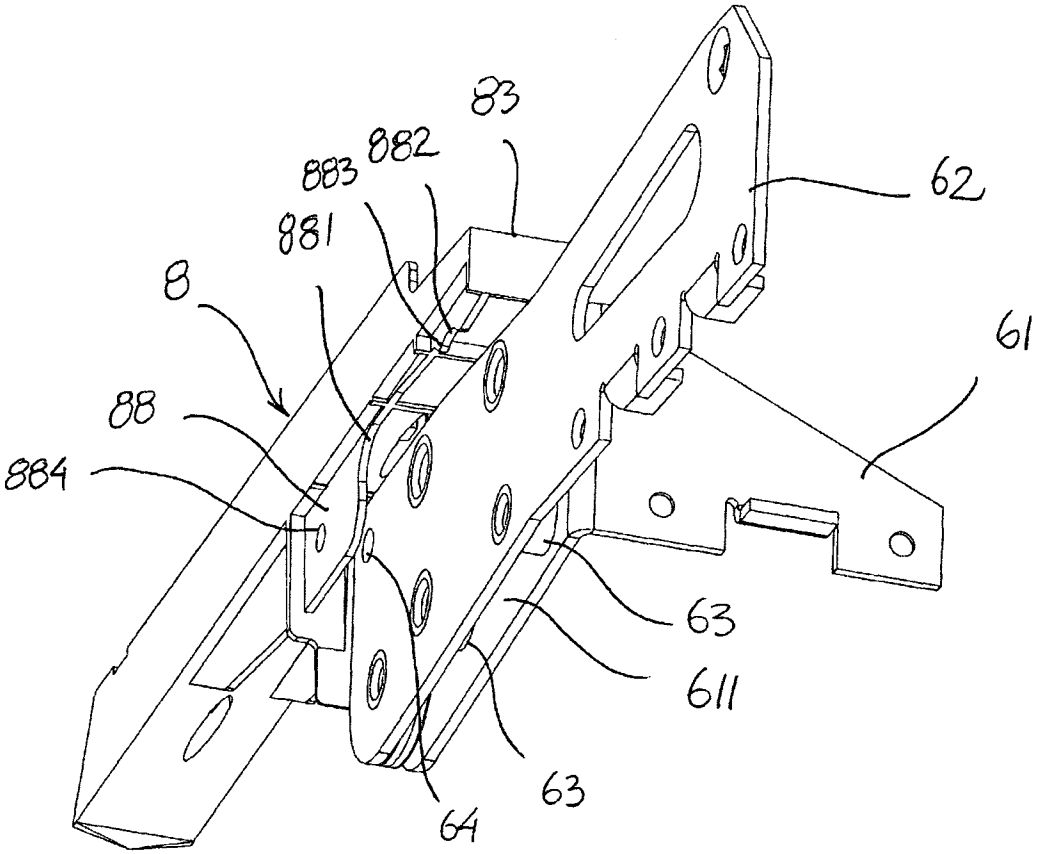
Figure 8:
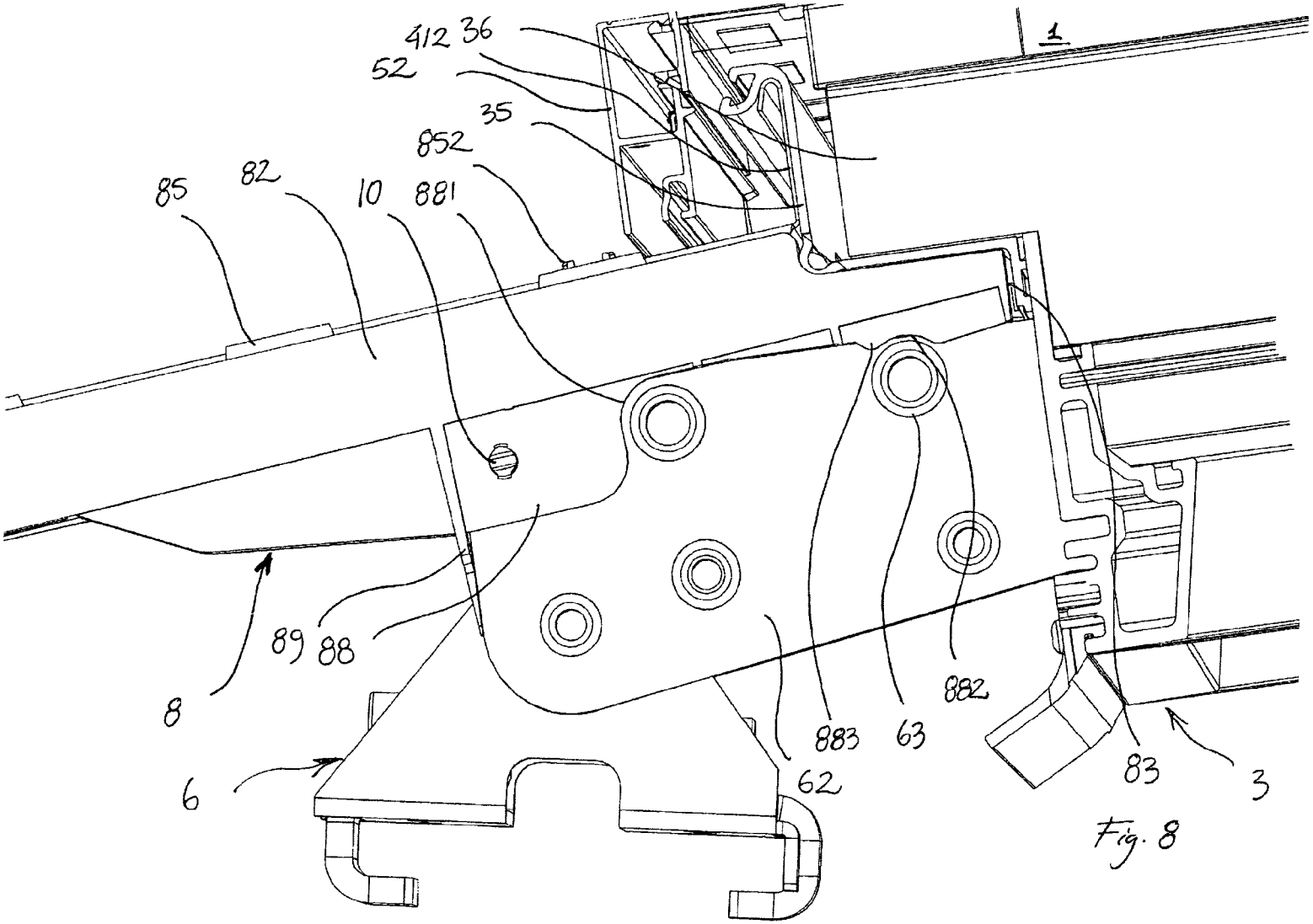
Figure 9:
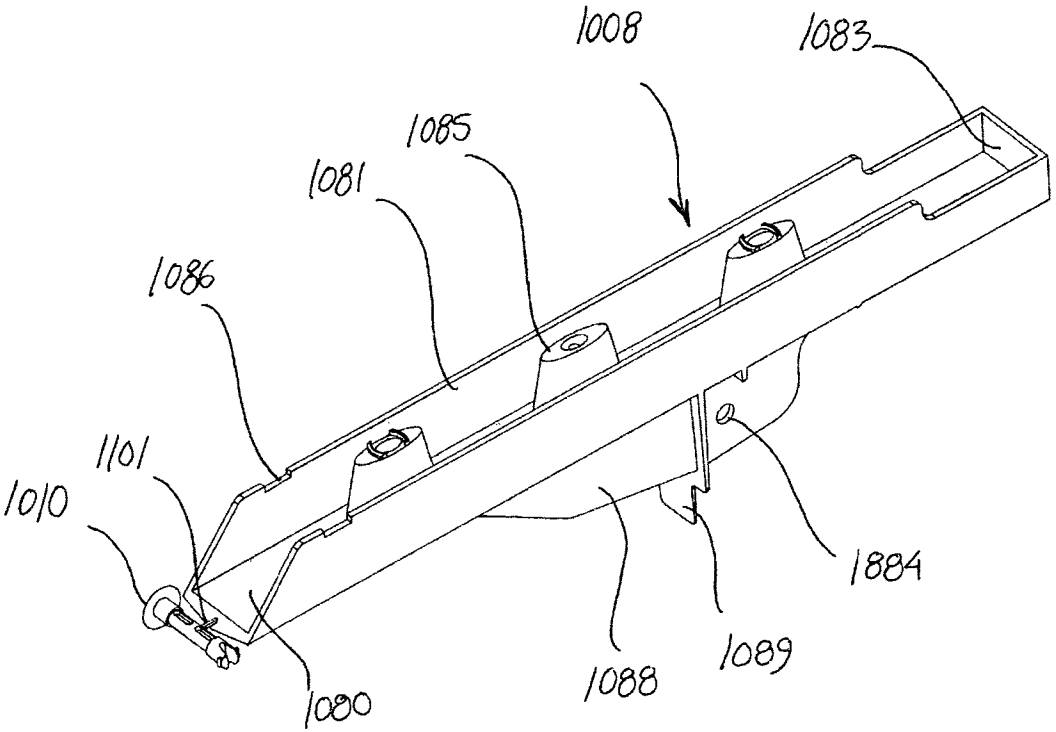
Figure 10:
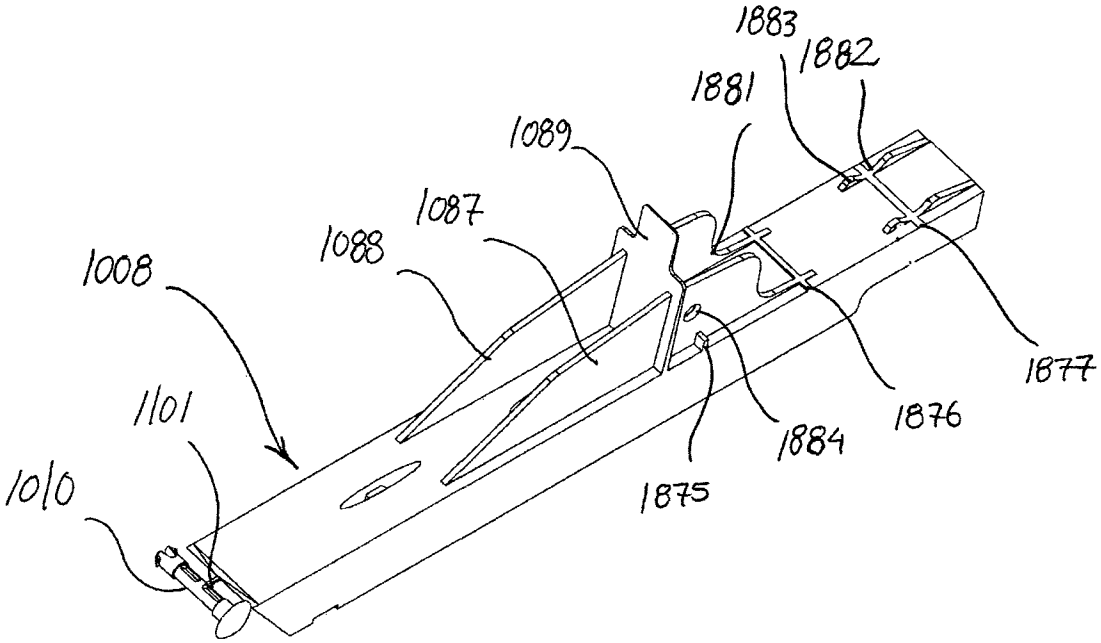
Figure 11:
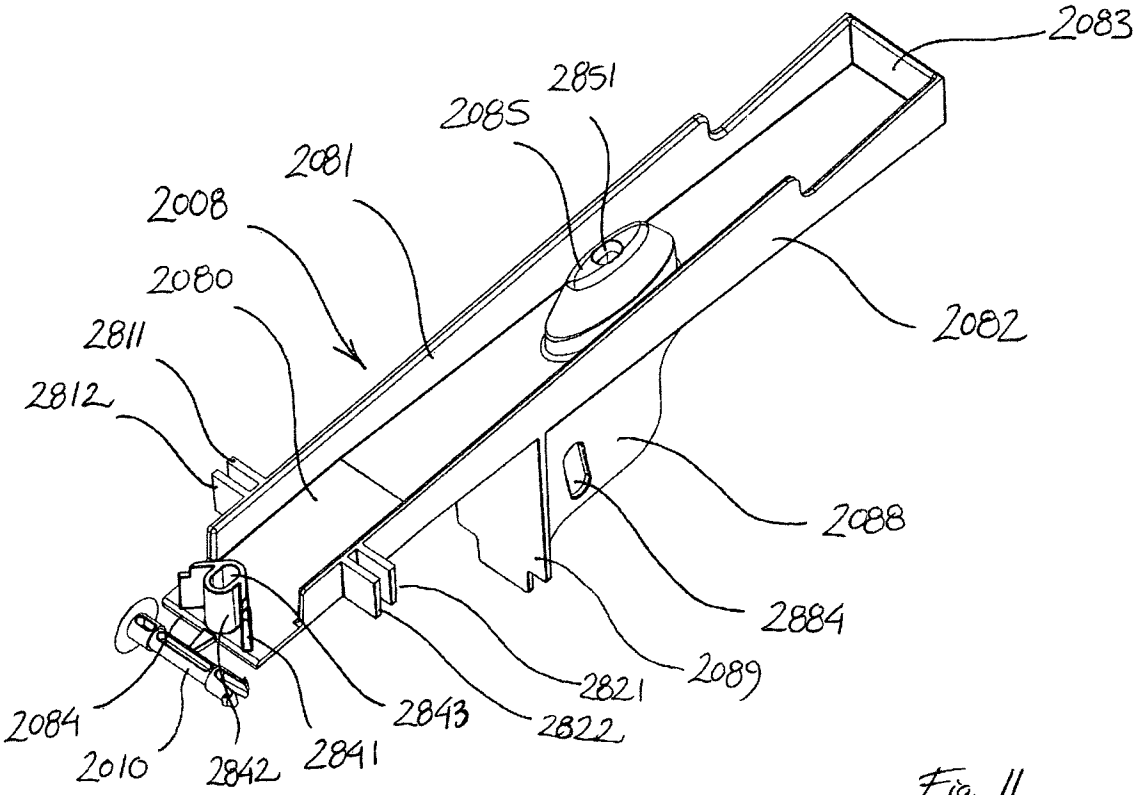
Figure 12:
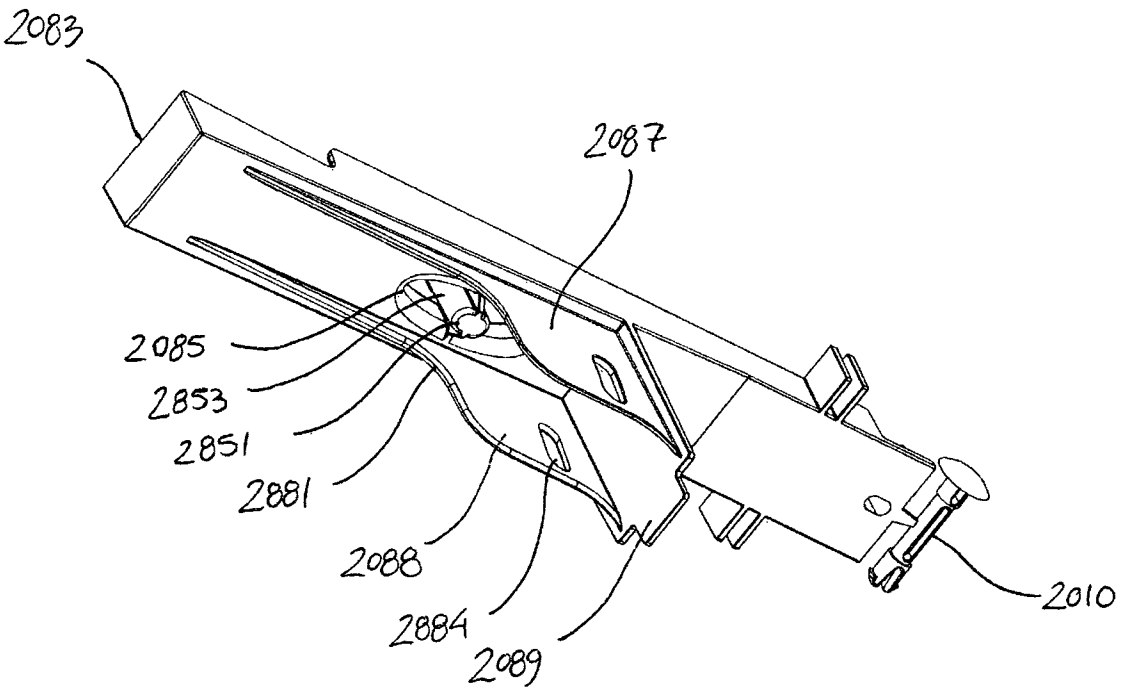
Figure 13:
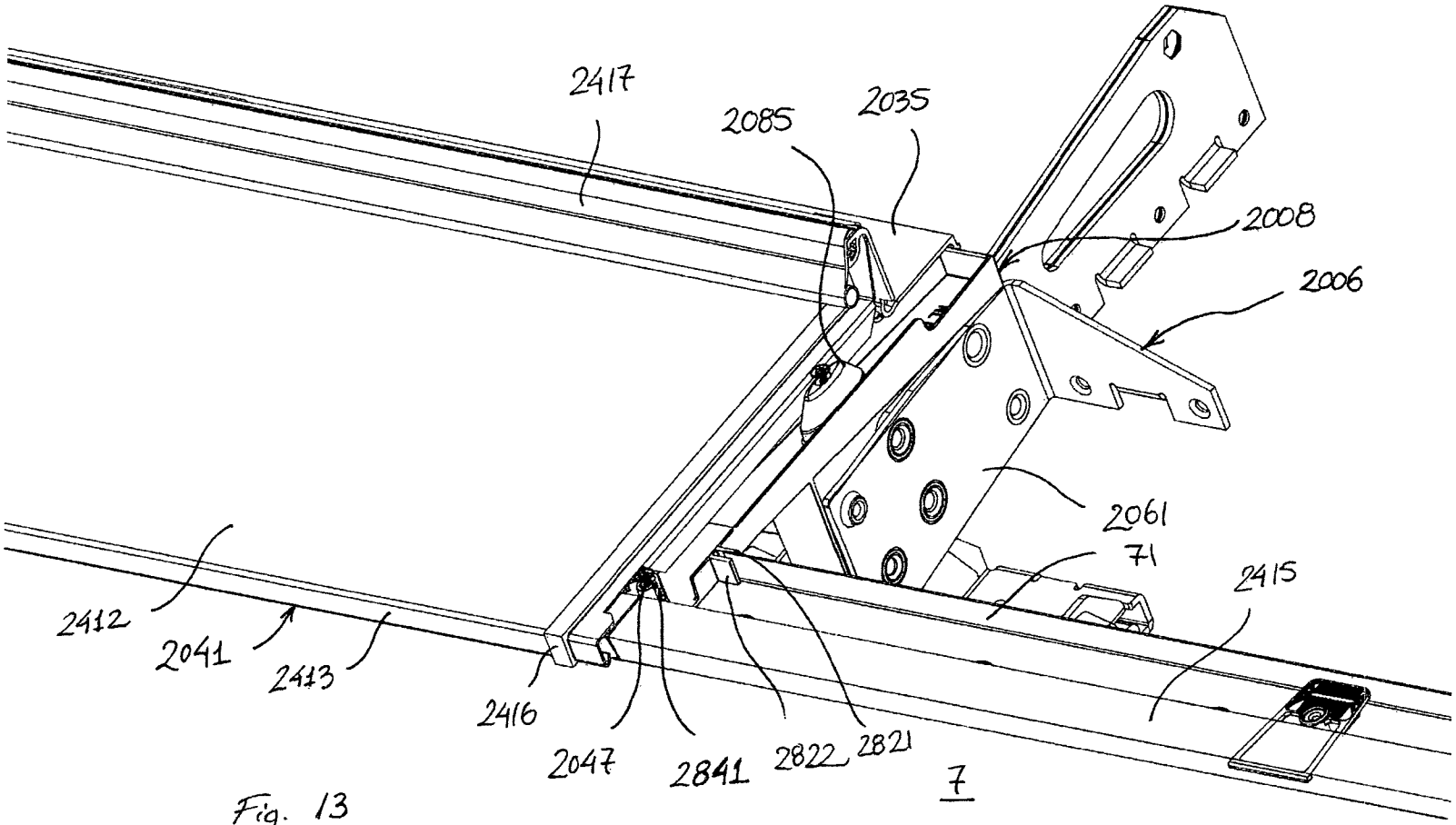
Figure 14:
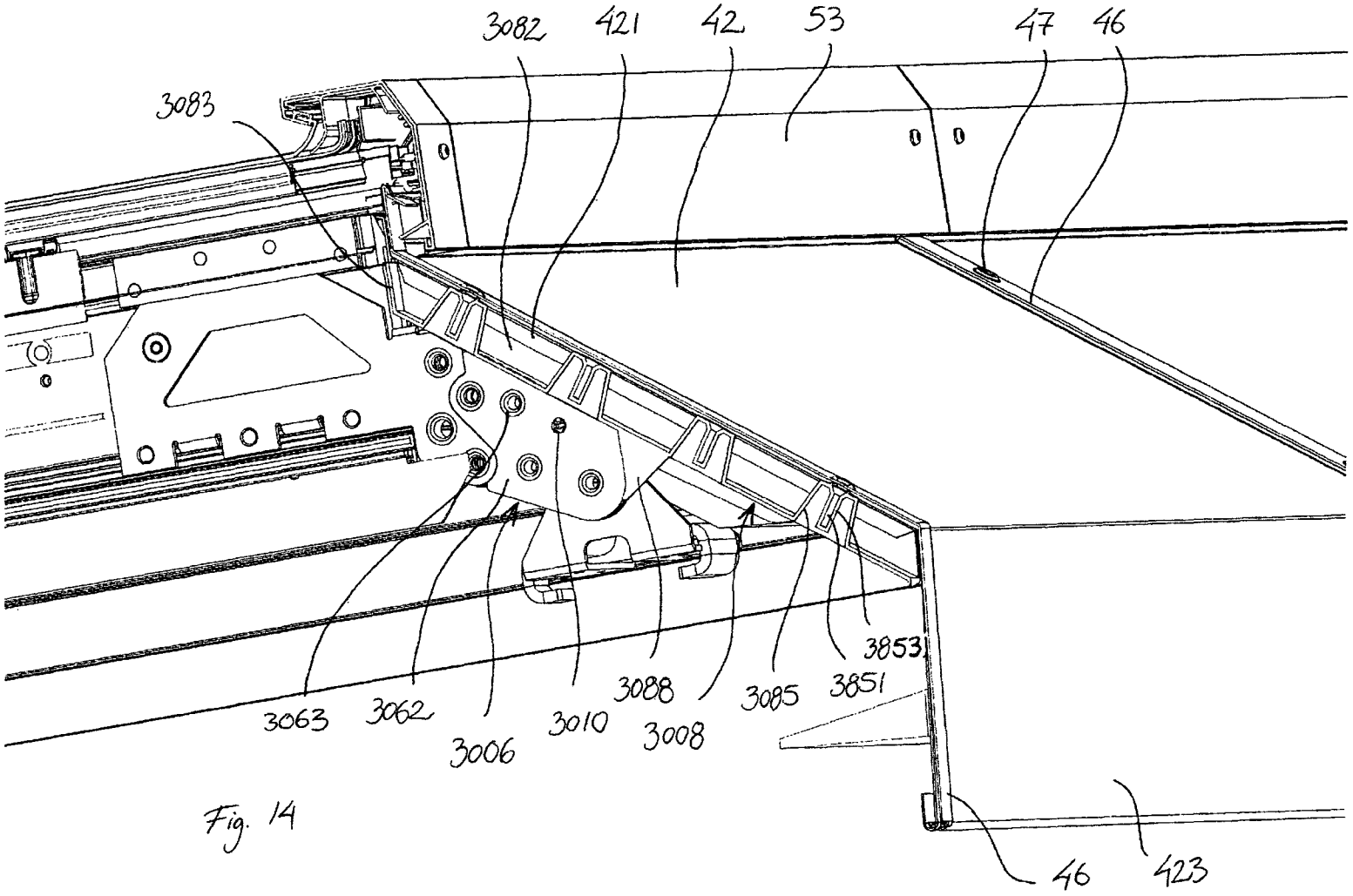
Figure 15:
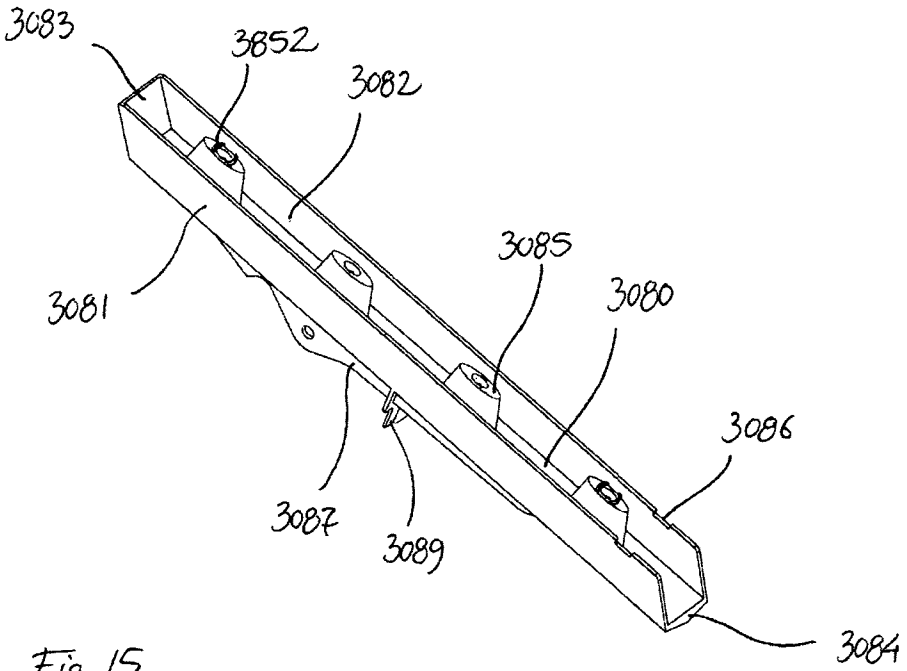
Figure 16:
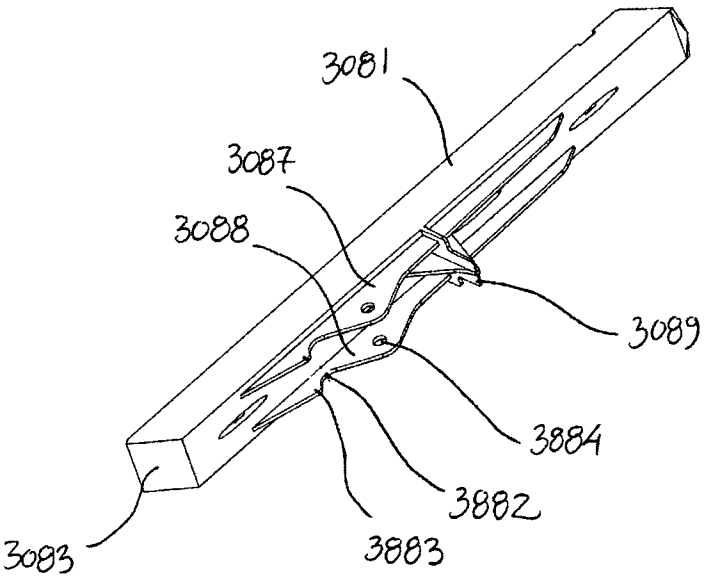

In the following the invention will be described in closer detail with reference to the drawing where FIG. 1 is a perspective view showing three windows installed as a group with one common covering and flashing assembly, FIG. 2 is a closer view of the detail marked II in FIG. 1, but with two of the flashing members removed, FIG. 3 shows the connector element in FIG. 2 in a perspective view from the exterior side, FIG. 4 shows the connector element in FIGS. 2 and 3 from the interior side, FIG. 5 shows a different embodiment of a connector element with an adaptor element attached, FIG. 6 corresponds to FIG. 2, but shown from the direction indicated by the arrow VI in FIG. 2 and with the right-hand window and associated flashing and covering members removed except for the mounting bracket, FIG. 7 is a perspective illustration of a connector element mounted on a mounting bracket, FIG. 8 corresponds to FIGS. 2 and 6, but shown from yet another direction indicated by the arrow VII in FIG. 2 and with the right-hand window and associated flashing and covering members removed except for a cross section of the bottom frame member being shown, FIGS. 9 and 10 show the connector element in FIG. 5 without the adaptor element, FIGS. 11 and 12 show a third embodiment of a connector element, FIG. 13 shows the connector element in FIGS. 11-12 in a mounted state, but where the two neighbouring windows are represented only by a few components including the mounting brackets and where a right-hand flashing member and an intermediate flashing member is removed, FIG. 14 is a cross-section along the line XIV-XIV in FIG. 1, FIGS. 15 and 16 show the connector element in FIG. 14 in a perspective view from the exterior side and from the interior side, respectively.

Figure 17:
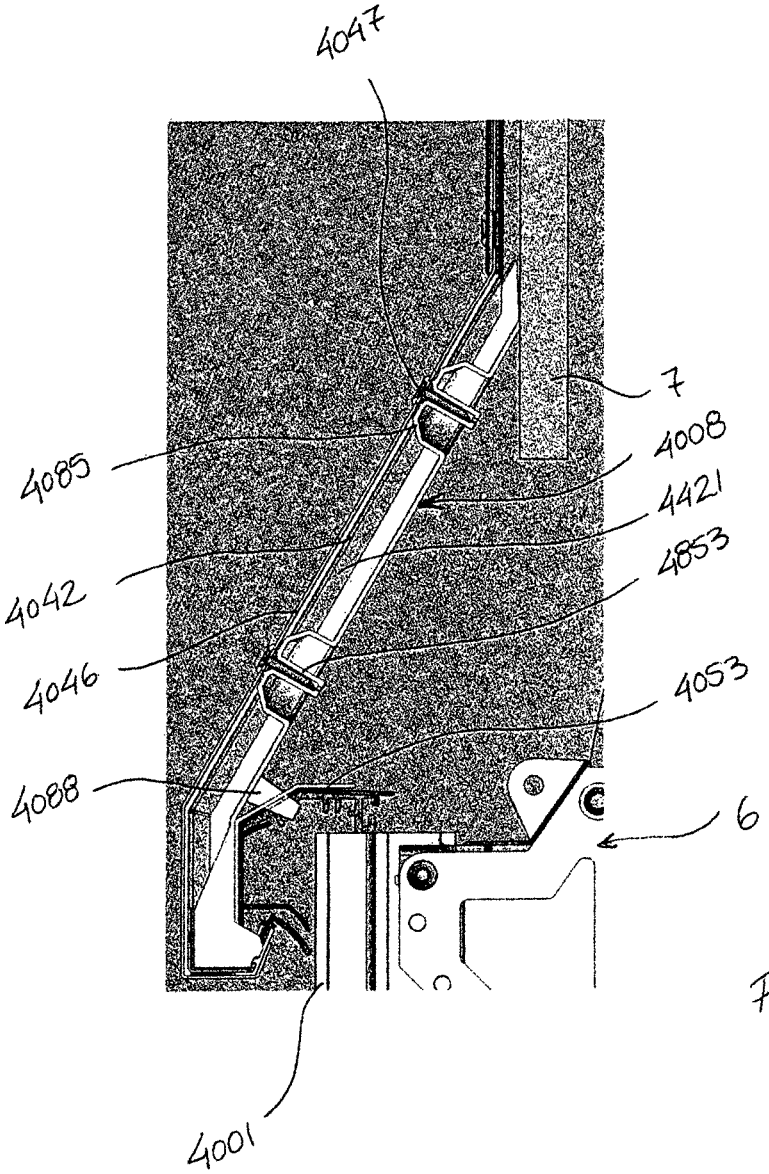
Figure 18:
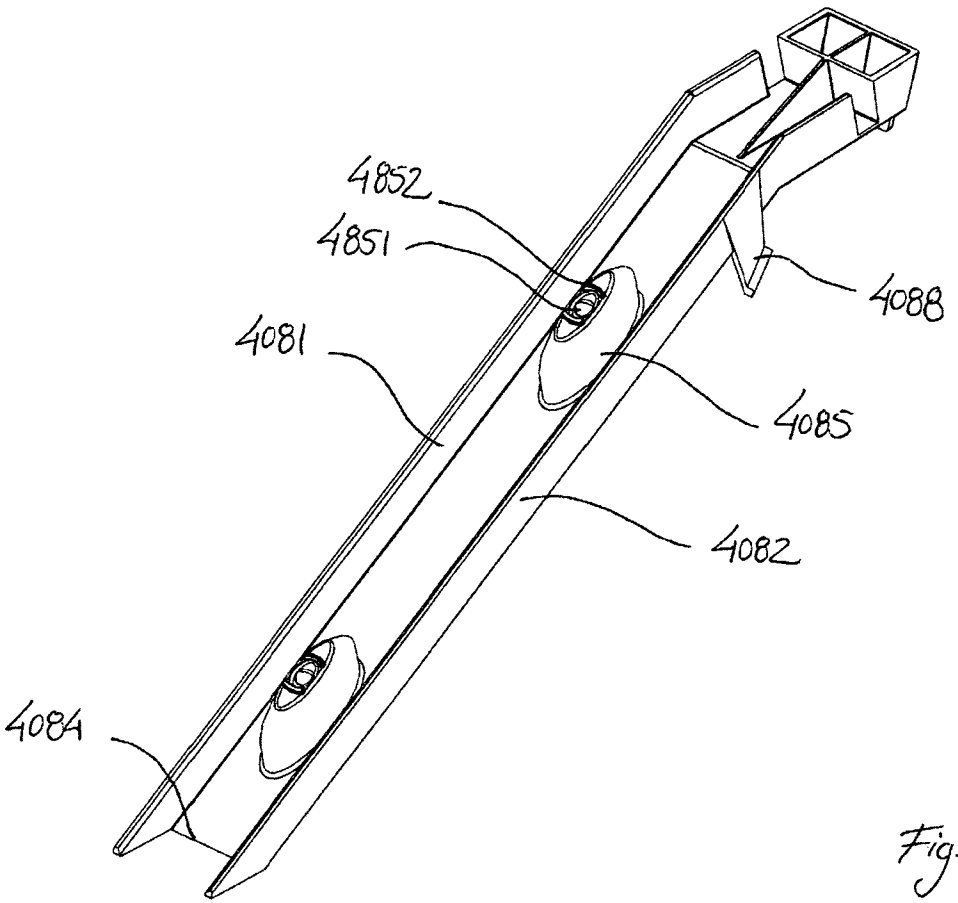
Figure 19:
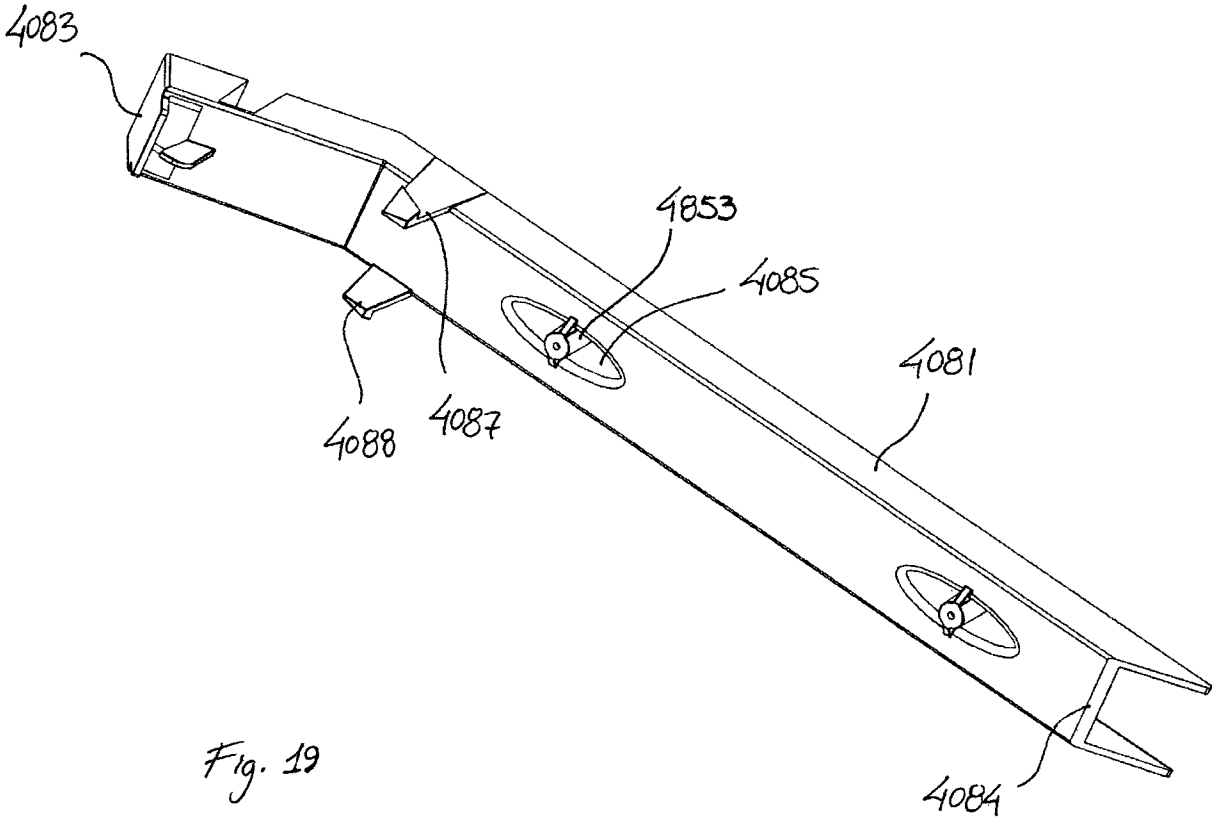

FIG. 17 is a cross-sectional sketch showing the use of a connector element at the top of a window mounted with a very steep inclination, and FIGS. 18 and 19 show the connector element in FIG. 17 in a perspective view from the exterior side and from the interior side, respectively.

A series of three windows is shown in FIG. 1. Each window comprises a pane element 1 supported by a sash structure 2 (not shown), which is connected to a frame 3 in a manner known per se and mounting brackets 6 are provided at each corner of a window, see also FIG. 2. A covering and flashing assembly 4 includes a plurality of flashing members 41-46 used for bridging the gap between the windows and the building surface (not shown) in which they are mounted, and a plurality of covering members 51-54 used to cover exterior surfaces of the windows.

In the embodiment shown in FIGS. 1, 2, 6, 8 and 14 the flashing members 41-46 and the mounting brackets 6 are adapted for installation of windows with a relatively low inclination on a so-called upstand (not shown), which is a load-bearing frame construction typically formed on a roof with limited inclination as described for example in EP2472027. It is, however, to be understood that the present invention works equally well in other installation situations, where the flashing assembly and mounting brackets are of a different configuration, as will also be explained with reference to FIGS. 11-13.

Turning now to FIG. 2, where the bottom flashing member 41 of the right-hand window and the intermediate flashing member 45 used between the bottom flashing members of the two neighbouring windows have been removed, a connector element 8 is seen riding on the mounting bracket arrangement 6.

In the embodiments shown the mounting brackets 6 are of a design with two plate members 61,62 extending in parallel away from the window frame and these plate members are separated by intermediate members in the form of tubular spacer members 63 extending between holes in the respective plate members. The spacer members may be used as guides for bolts (not shown) used for interconnection the mounting brackets of the two windows to contribute to the stability of the group of windows or as points of attachment for other parts of the window such as operators (not shown) arranged on the outer side of the window frame.

The connector element 8, which is shown alone in FIGS. 3 and 4, comprises a gutter defined by a bottom 80 and two longitudinal edge flanges 81,82 extending between a first upper end 83 (not visible in FIG. 2) and a second lower end 84 on the exterior side.

The bottom flashing member 41 of the left-hand window has a bent edge 411 serving as an engagement section and projecting down along the inner side of the left longitudinal edge flange 81. This allows water on the flashing member to drain into the gutter, but primarily serves to keep the flashing member in place. It is to be understood that the bottom flashing member of the right-hand window is also in engagement with the connector element in a similar way and that the intermediate flashing member 45 bridges the gap between the two bottom flashing members. It will, however, also be possible to make one or both bottom flashing members a bit longer so that one or both of them overlap the connector element.

In this embodiment the connector element 8 is arranged between the two mounting brackets as will be explained in further detail below, and is therefore centred in relation to the two windows, extending in continuation of the joint between them. This centred position of the connector element 8 entails that the joint between neighbouring flashing members will also be centred, which will lead to an aesthetical advantage, but it is of course also possible to provide a connector element at each mounting bracket. In that case an extra-wide version of the intermediate flashing member, which is preferably attached to both connector elements, may be used. Moreover, the centred position also allows the use of the connector element for draining off water collected in drainage channels between windows (not shown) and/or by covering and cladding members used at the joint.

The second end of the connector element is open so that water ending up in the gutter may drain off onto a surface of the building, such as a roofing or an additional flashing member (not shown) as described in EP2472027.

At the centre of the gutter three raised sections 85 are provided. These raised sections are adapted for supporting the intermediate flashing member 45 and are provided with openings 851 adapted for receiving screws or like fasteners penetrating through the intermediate flashing member. The raised sections preferably comprising an interior boss adapted for receiving and guiding the screw. Here the raised sections are embodied as frustroconical towers with an elliptical cross-sectional shape, but it is to be understood that they may have other shapes, being for example a simple cylindrical boss or having a rectangular cross-section. In all circumstances their width at the base should be so sufficiently small that water may pass in the gutter.

Two of the raised sections are each provided with two small projections 852, one on either side of the opening 851. These projections are adapted for fitting into depressions (not shown) in the intermediate flashing member, so that the person mounting the intermediate flashing member will get a tactile feedback when it is in place.

As suggested in FIG. 1 each intermediate flashing member 45 is here attached by means of two screws 47, corresponding to only the two raised sections with projections being used in this installation situation. The third raised section may serve as a support, preventing the intermediate member from buckling downwards, but the primary purpose of the third raised section is to allow the same connector element to be used for different installation situations. As an example the outermost part of the connector element closest to the second end 84 may be cut or broken off, if the bottom flashing members are of a comparatively small length in the direction away from the frame structure. Cutting lines or weakening zones (not shown) may be provided to aid such an adaptation. As another example the intermediate flashing member may be attached using three fasteners if for example the windows are mounted where high window loads may be expected.

Likewise there may be a need for a longer connector element and the connector element is therefore preferably adapted for attachment of an adaptor element 9 as shown on a different embodiment of the connector element in FIG. 5. Features in this embodiment having the same or analogue function as features in FIGS. 1-4 have been given the same reference number but with 1000 added.

The adaptor element in FIG. 5 is of a very simple design, having a cross-sectional shape corresponding to that of the connector element 1008 at the second end 1084 and fitting over the interior side thereof. It is attached by means of two bendable tongues 91 fitting into and over small recesses 1086 in the longitudinal edge flanges 1081,1082, similar recesses 86 being found on the connector element 8 in FIGS. 2-4.

For use in the mounting on the mounting brackets the connector element 8 is further provided with a two parallel flanges 87,88 projecting from the interior side and arranged at a distance corresponding to the distance between surfaces of the mounting brackets on neighbouring windows so that they may each come into engagement with a mounting bracket. This allows the connector element to be positioned on the mounting brackets 6 as shown in FIG. 6.

As may be seen particularly clearly in FIG. 7, the mounting brackets in this embodiment are each made with two plate members 61,62 interconnected by spacer members 63. In the mounted state the outer surface of the second plate member 62 will be in engagement with the corresponding surface on the mounting bracket on the neighbouring window this forming the mounting bracket arrangement. The spacer members 63 are here cylindrical with an opening extending from one plate member to the other and bolts of like fasteners (not shown) may be passed through aligned spacer members on neighbouring mounting brackets, thereby fixating the mounting brackets in relation to each other.

The projecting flanges 87,88 of the connector element are here adapted for engaging the surfaces of the first plate member 61 of neighbouring mounting brackets facing the respective second plate member 62. This allows the connector element to be in a tight-fitting manner, when the distance between the flanges is made to correspond closely to the distance between these surfaces. If the flanges are elastic, the distance may be made only slightly larger than the distance between the surfaces of the mounting brackets so that the flanges are pressing against the surfaces in the mounted state.

As shown in FIG. 8 the flanges 87,88 are each shaped with curved recesses 881, 882 and a projection 883 fitting the shape and position of the spacer members 63 in the mounting brackets. Alone or in combination with the tight fit between the mounting brackets, this system of recesses and projection allows the connector element to be mounted on the mounting bracket in a manner, where it is at least loosely fixated in the length direction of the connector element, thus providing a locking engagement with the mounting bracket arrangement in at least one direction. Moreover, the system of recesses and projection will provide a tactile feedback to the person mounting the connector element, so that he will know when the connector element is in place.

With the system of recesses 881,882 and projection(s) 883 locking onto the spacer members 63 it would in principle be sufficient to have only a single interior flange extending in parallel with the longitudinal edges of the gutter. Such a single flange could then be made extra thick to provide strength and stability to the connector element. It would even be possible to provide a single flange filling a space between plate members of the mounting bracket arrangement entirely, so that opposite outer surfaces of the interior flange were in engagement with different plate members of the mounting bracket arrangement.

Transverse stiffening ribs 875,876,877 extending from the outer side of the one edge flange 81,82 to the other also contributes to the correct positioning of the connector element by riding on top of the plate members 61,62 of the mounting brackets.

A particularly good fixation and tactile feedback will be achieved when the first end 83 of the connector element is arranged underneath another member of the window, so that upwards movement of the connector element away from the mounting bracket is prevented or at least hindered. In the embodiment shown, the edge flanges 81,82 are of reduced height at the upper part of the connector element projecting projection between the flashing member and the frame of a window. This allows the first end of the connector element to be inserted underneath a frame extension element 35 attached to the bottom member of the frame and a side frame cover cap 36 attached to the side member of the frame, but other configurations are of course possible as will be readily apparent to the skilled person.

The frame extension member 35 may serve as a drainage element leading water from the bottom of the window into the gutter of the connector element and is further used for fixating a leg of the bottom flashing member 41 as seen in FIGS. 6 and 8 and a corresponding leg (not shown) of the intermediate flashing member 45. The frame extension member 35 may extend over an operator or the like (not shown) located on the outer side of the frame bottom member.

As may be seen in FIGS. 6 and 8 the uppermost part of the connector element 1008 functions as an extension of the gutter having only drainage purposes but not being in contact with the flashing members.

Still another feature contributing to the correct positioning of the connector element is a third interior transverse flange 89, which comes into abutment with the outer edges of the plate members 61,62 of the mounting brackets as shown in FIGS. 6-8. This abutment prevents the connector element from being pushed too far towards the frame of the window in situations where the first end 83 is not intended to be in direct engagement with the frame 3. The third flange has the added advantage that is blocks the entrance to the spaces between plate members of the mounting brackets, thereby potentially improving the insulating properties of the window system.

The attachment of the connector element 8 to the mounting brackets may be secured by passing a fastener 10 through aligned openings 884,64 in the connector element and the mounting brackets 6. This fastener may be of any suitable type such as a screw, a bolt, a cotter, a split pin or a peg, which may be provided with barbs.

In an advantageous embodiment, the fastener 10 is provided as an integrated part of the connector element 8 ready for being cut or broken off during or after the mounting of the connector element on the mounting bracket arrangement.

An example of a connector element with such an integrated fastener is shown in FIGS. 5, 9 and 10, where features having the same or analogue function as features in FIGS. 1-4 and 6-8 have been given the same reference number but with 1000 added.

As may be seen the fastener 1010 is connected to the connector element 1008 only by a thin string of material 1101 and when the connector element is made from a polymer, this string of material is easily broken by simply turning and/or pulling on the fastener by hand. Neither the fastener nor the connection to the connector element have to be made from the same material as the connector element, but making them from the same material allows them all to be made in one moulding process. It is to be understood that the fastener may be designed in other ways than shown in FIGS. 9 and 10 and that both the provision of an integrated fasteners and the design of the fastener and its connection to the connector element are independent on the other features of the connector element.

Apart from the fastener the connector bracket in FIGS. 9 and 10 differs from that in FIGS. 2-8 in that the flanges on the interior side are somewhat smaller and completely lacking on a section between the recesses 1881,1882 and that the stiffening ribs 1875,1876,1877,1878 are of a different configuration.

The smaller flanges allows the connector element 1008 to be used in window systems, where the distance between the spacer members and the exterior edges of the plate members 61,62 and/or between the exterior edges of the plate members and the part of the window system located above the connector element as described above is/are smaller.

The different configuration of the stiffening ribs means that the angle between the gutter and the exterior edges of the plate members will be different, allowing either adaptation to a different design of the mounting brackets or to different installation situations such as the angle of inclination of the window system in the mounted state.

A third embodiment of a connector element 2008 is shown in FIGS. 11-13, where features having the same or analogue function as features in FIGS. 1-4 and 6-8 have been given the same reference number but with 2000 added, while 1000 has been added to reference numbers only found in FIGS. 5, 9 and 10. As in the description with reference to FIGS. 5, 9 and 10 above, only features having a different function and/or structure than previously described with reference to other embodiments will be described.

The primary difference between the connector element 2008 in FIGS. 11-13 and those described above is that this connector element has a deflector flange 2841 projecting from the bottom 2080 of the gutter at the second end 2084 and a set of roofing flanges 2811,2812;2821,2822 projecting from the outer side of each edge flange 2081,2082, respectively.

The deflector flange 2841 prevents water from being pressed upwards into the connector element 2008 under the influence of heavy wind, particularly when the second end 2084 is resting directly on a roofing 7 extending up underneath the bottom flashing member 2041 as shown in FIG. 13 or a supplementary flashing member (not shown) arranged in plane with the roofing. Such structures are typically found where the windows are mounted with a very steep inclination on an upstand, such that the bottom flashing member 2041 extends substantially in continuation of the outer side of the upstand, or where the windows are mounted on a frame structure or like load-bearing structure, which is embedded in the roof structure.

To allow the connector element 2008 to still serve as a drainage element, the edge flanges 2081, 2082 are interrupted at a distance from the second end 2084 to form drainage openings between them and the deflector flange 2841. Here the flange 2841 is V-shaped so that water in the gutter will be led to both sides, but it is to be understood that it might also be a straight flange leading water only to one side and that one of the edge flanges to the other side would then not have to interrupted. Likewise it is to be understood that the edge flanges do not have to be interrupted entirely, but that they might instead be provided with holes or like openings close to the bottom 2080 of the gutter.

The roofing flanges 2811,2812;2821,2822 are intended for receiving a bent edge 71 of a roofing material 7 thus keeping the bent edge in place and contributing the preventing water from be pressed upwards above the roofing material. A sealing strip 2415, which is preferably made of a compressible and water-repelling material, is further provided on the exterior side of the roofing underneath the lowermost part of the bottom flashing member 2041.

Further sealing strips 2416,2417 may be provided on or at the bottom flashing members 41 for sealing against the interior sides of the intermediate flashing member 45 and bottom covering members 51,52.

In the embodiment shown a boss 2842 is provided at the bend on the deflector flange 2841. This boss at the same serves to give stability to the deflector flange and as a raised section adapted for receiving a screw when mounting the intermediate flashing member 45 as described above. Accordingly, this connector element 2008 has only one raised section 2085 of the type described above. More raised section may of course be provided although this embodiment is not immediately suited for being shortened as described above.

The interior side of this connector element 2008 is shown in FIG. 12 and is of a very simple design with no transverse ribs and only one curved recess 2881. This means that the locking engagement with the mounting bracket arrangement 6 is achieved only by the contact between the flanges 2087,2088 and the plate members 2061,2062 of the mountings brackets, but more complex designs are of course also possible here.

The engagement is secured by a fastener 2010 being inserted through the openings 2884 as described above. The openings 2884 are here depicted as elongate, allowing some flexibility in the connection between the connector element 2008 and the mounting brackets 6, but it may also be circular as in the other embodiments and vice versa.

It is noted that a boss 2853 in the raised section 2085 as previously described with reference to the raised sections in FIG. 1 can here be seen in FIG. 12.

The connector elements 8,1008,2008 described above with reference to FIGS. 2-13 are used at the bottom of the windows, but like connector elements may also be used at the top of the windows.

FIG. 14 shows a cross-section at the top of the window along the line XIV-XIV in FIG. 1, where a fourth embodiment of a connector element 3008 is used and this connector element is shown in detail in FIGS. 15 and 16. Features having the same or analogue function as features in FIGS. 1-4 and 6-8 have been given the same reference number but with 3000 added, while 2000 has been added to reference numbers only found in FIGS. 5, 9 and 10 and 1000 has been added to reference numbers only found in FIGS. 11-13. Only features differing from those already described will be explained in detail here.

The connector element 3008 in FIGS. 14-16 comprises four raised sections which are each of substantially the same configuration as described with reference to the connector element in FIGS. 1-4 and 6-8. Here, however, the bosses 3853 inside the raised sections may be seen.

The interior side of the connector element 3008 in FIGS. 14-16 is without stiffening ribs and thus riding with the interior surface of the bottom 3080 of the gutter in direct contact with the exterior edge of the plate members 3061, 3062 of the mounting brackets.

Moreover, the flanges 3087,3088 on the interior side are provided only with a single curved recess 3882 and a projection 3883 for engagement with the spacer members 3063 of the mounting brackets. This difference is due to the different configuration of the mounting brackets used at the top and at the bottom, which may be seen by comparing FIG. 14 to FIG. 7. It is, however, to be understood that these mounting brackets may be designed in many other ways and that the undersides of the connector elements will vary accordingly, including the possibility that they may be alike.

A different embodiment of a connector element 4008 for use where the top flashing member is without the downwards projecting leg 423 and the connector element contacting the roofing material is shown in FIGS. 17-19, this embodiment not being within the scope of the present claims. Features having the same or analogue function as features in FIGS. 1-4 and 6-8 have been given the same reference number but with 4000 added, while 3000 has been added to reference numbers only found in FIGS. 5, 9 and 10, 2000 has been added to reference numbers only found in FIGS. 11-13 and 1000 has been added to reference numbers only found in FIGS. 14-16.

As may be seen from the cross-section in FIG. 17, which corresponds to the cross-section in FIG. 14 except for showing a different installation situation and looking the other way, the connector element is here connected to exterior side of the top covering member 4053. This embodiment is primary intended for windows mounted with a very steep inclination and water on the roofing may then run over the top flashing member 4042 and directly onto the pane 4001 of the window.

The interior flange 4087,4088 on the interior side are here embodied as local projections with barbs intended for locking into openings in the top covering 4053 and/or a rail element supporting it. In addition the first end 4083 nearest to the window is embodied with openings to the sides as at the second end 2084 of the connector element 2008 in FIGS. 11-13.

The connector elements 8, 1008, 2008, 3008, 4008 are preferably made from plastic, such as acrylonitrile butadiene styrene (ABS), polyethylene (PE), polypropylene (PP) or polyvinylchloride (PVC), but other materials including metals and composites and combinations thereof may be employed as long as they are able to withstand the conditions on a roof.

Several embodiments of connector elements have been described above and it is to be understood that different features of these embodiments may be combined into new embodiments without departing from the scope of the claims. Particularly the features relating to the exterior sides of the connector element, such as the design of the edge flanges and the raised projections, are to be considered as independent of the features on the interior side, such as the parallel interior flanges, the transverse flange and the stiffening ribs. Likewise it is to be understood the length of the connector elements may vary greatly depending on the installation situation and that the length and number of raised sections, including the distance between the raised sections, should therefore not be regarded as related to other features of any of the connector elements shown and described.

The invention claimed is:

1. A connector element for use in a flashing assembly for roof windows mounted side-by-side comprising at least two flashing members each having a leg intended for being arranged so that it projects away from the window frame, said connector element having an exterior side intended for facing the exterior in the mounted state, an interior side intended for facing the roof in the mounted state, a first end intended for facing the window and a second open end intended for facing away from the window, where the exterior side comprises a gutter with two longitudinal edges extending between the first and second ends, each of said longitudinal edges being adapted for engagement with an engagement section of a flashing member, and where at least one flange projects from the interior side and is adapted for coming into engagement with a mounting bracket on a roof window, further comprising at least two flanges projecting from the interior side in parallel with the longitudinal edges of the gutter are adapted for a locking engagement with a mounting bracket arrangement including at least two mounting brackets associated with two different roof windows mounted side-by-side, said locking engagement fixing the connector element in relation to the mounting bracket arrangement in at least one direction, each of the at least two flanges being intended for coming into abutment with a surface of one of the two mounting brackets and each flange being provided with two or more curved recesses, each recess being adapted for riding on intermediate members of the mounting bracket arrangement in a manner so that when the curved recesses in the flanges have passed over the intermediate members during installation the connector element, once in place will be at least loosely fixated in the length direction of the connector element and will have to be pulled toward the exterior, away from the intermediate members, to be able to move in the longitudinal direction of the gutter, and the connector element further comprises a third flange projecting from the interior side, said third flange being perpendicular to the longitudinal edges of the gutter and being adapted for abutting lower outer ends of the two mounting brackets facing away from the window frame.

2. A connector element according to claim 1, further comprising an extension of the gutter at the first end adapted for projecting between a flashing member and the frame of a window.

3. A connector element according to claim 1, where two or more raised sections are provided in the gutter for receiving fasteners.

4. A connector element according to claim 3, where one or more of the raised sections are provided with projections fitting into depressions in a flashing member or vice versa.

5. A connector element according to claim 3, where three or more raised sections are provided corresponding to different installation situations.

6. A connector element according to claim 1, comprising one or more projections or depressions adapted for engagement with an adaptor element.

7. A connect element according to claim 3, where at least sections of the connector element are made from a white or bright-coloured material.

8. A connector element according to claim 1, further comprising a fastener formed in one with the connector element and adapted for being broken off an inserted through an opening in the connector element and at least one opening in a mounting bracket.

9. A window system with a flashing assembly mounting by the use of at least one connector element according to claim 1.

10. A connector element according to claim 2, where two or more raised sections are provided in the gutter for receiving fasteners.

11. A connector element according to claim 10, where one or more of the raised sections are provided with projections fitting into depressions in a flashing member or vice versa.

12. A connector element according to claim 10, were three or more raised sections are provided corresponding to different installation situations.

13. A connect element according to claim 4, where at least sections of the connector element are made from a white or bright-coloured material.

14. A connect element according to claim 5, where at least sections of the connector element are made from a white or bright-coloured material.

15. A connect element according to claim 6, where at least sections of the connector element are made from a white or bright-coloured material.

16. A connector element according to claim 2, comprising one or more projections or depressions adapted for engagement with an adaptor element.

17. A connector element according to claim 16, where two or more raised sections are provided in the gutter for receiving fasteners.

18. A connector element according to claim 3, comprising one or more projections or depressions adapted for engagement with an adaptor element.

19. A connector element according to claim 18, where one or more of the raised sections are provided with projections fitting into depressions in a flashing member or vice versa.

* * * * *